US006209431B1

(12) United States Patent
Wickham

(10) Patent No.: US 6,209,431 B1
(45) Date of Patent: Apr. 3, 2001

(54) AUTOMATED DEGATE AND TRIM MACHINE

(76) Inventor: John L. Wickham, 11752 Harford Rd., Glen Arm, MD (US) 21057

( * ) Notice: Subject to any disclaimer, the term of this patent is extended or adjusted under 35 U.S.C. 154(b) by 0 days.

(21) Appl. No.: 09/172,523

(22) Filed: Oct. 14, 1998

(51) Int. Cl.[7] ..... B26D 7/06

(52) U.S. Cl. ..... 83/165; 83/13; 83/157; 164/331

(58) Field of Search ..... 83/165, 34, 13, 83/157; 164/314, 80, 70, 347, 303, 131, 264, 262, 312, 316, 331; 198/163, 750, 701

(56) References Cited

U.S. PATENT DOCUMENTS 2,364,011 * 11/1944 Wales ..... 164/96
3,854,521 * 12/1974 Hannes ..... 164/347
3,875,834 * 4/1975 Vulcano ..... 83/1
4,064,928 * 12/1977 Wunder ..... 164/264
4,248,289 * 2/1981 Perrella et al. ..... 164/153
4,463,634 * 8/1984 Lee ..... 82/34 R
4,592,407 * 6/1986 Yamaguchi et al. ..... 164/265
4,842,038 * 6/1989 Fujino et al. ..... 164/80
4,886,106 * 12/1989 Bennett ..... 164/70.1
5,127,467 * 7/1992 Ueno ..... 164/457
5,201,812 * 4/1993 Goss ..... 164/404
5,234,884 * 8/1993 Magnuson ..... 83/100
5,435,956 * 7/1995 McCrory ..... 264/161
5,725,041 * 3/1998 Schultz ..... 164/5

* cited by examiner

*Primary Examiner*—Lee Young
*Assistant Examiner*—Minh Trinh
(74) *Attorney, Agent, or Firm*—Leonard Bloom

(57) ABSTRACT

A general purpose molding and casting machine which will run unmanned to receive a casting assemblage and then separate the runners and sprue from the casting. Once the separation has taken place the casting is carried to the finished parts area and runners and sprue remnants are delivered to the scrap area for reuse.

9 Claims, 14 Drawing Sheets

AUTOMATED DEGATE AND TRIM MACHINE

RELATED APPLICATIONS

This application is related to Disclosure Document Number 416964, filed Mar. 19, 1997.

FIELD OF THE INVENTION

The invention finds applicability in the field of molding and casting.

Terms Used Herein:

DIE CASTING MACHINE is a machine that injects molten metal into a die (mold) to form a casting, or castings.

ROBOT is a programmable, automated device that is adapted to unload die casting machines and set the casting assemblage (Gate) down in an organized, predictable fashion.

GATE is the casting assemblage, consisting of the casting or castings, with the runners and the sprue, all tied together.

DEGATING is a process for removing the waste portion or gate remnant from the casting.

DEGATE-AND-TRIM MACHINE is a machine that utilizes a complex punch and die set to separate the good casting or castings from the gate, and then trim away the flash and/or overflow.

CASTING is the desired product resulting after degating.

GATE REMNANT is the portion of the gate that is separated from the castings by the degating and trim process.

BACKGROUND OF THE INVENTION

Modern die casting plants employ a number of die casting machines with a degate-and-trim machine alongside each casting machine. The die casting machines, in the larger sizes, are usually attended by a robot, and can thus run unmanned. The degate-and-trim machines are rarely automated as to loading and unloading, and thus require labor to operate.

In rare, high volume instances where degate-and-trim machines have been automated, the buildup of scrap (broken-off pieces of the gate, flash and overflows) inevitably hinders the proper working of the machine. This is the main reason that most degate-and-trim machines were never automated.

Objects of the Invention

A main object of this invention is to produce a machine which will automatically and efficiently separate the casting from waste material.

A significant object of this invention is to produce a machine for separating castings from scrap requiring a minimum amount of manpower.

Another object of this invention is to produce an efficient means for determining imperfections in different sets of castings.

A still further object is to produce a machine which will efficiently return scrap separated from the casting for recycling.

These and other objects of the present invention will become apparent from a reading of the following specification taken in conjunction with the enclosed drawings.

Problem Solved By This Invention

This invention completely solves the problem of scrap buildup, and permits easy interface with the robot that unloads the die casting machine. This permits seamless, unmanned operation between the two machines, namely, the mold and the degate and trim machine. Additionally, this invention provides a means for progressively removing parts from the gate while the die casting machine is making its next shot, thus the degate-and-trim machine does not have to be as big or expensive as that of the prior art.

BRIEF SUMMARY OF THE INVENTION

The invention covers a general purpose machine which will run unmanned to automatically remove die castings from their gates, trim the castings and send the trimmed castings to a parts container or bin. The scrap remnants and trim are automatically removed for remelting and use to manufacture additional castings.

The automated degate-and-trim machine works in the following manner. First, the robot grabs the gate while the gate is still hot and in the casting machine. A typical gate, and the robot's grippers might grab the casting around the sprue. The robot then brings the gate to the automated degate-and-trim machine (A.D. & T.M.) and sets the castings onto lower male fixtures positioned on the degating plate or platform. The A.D. & T.M.'s press then actuates, trimming and separating the castings from the gate. The press then opens, lifting the castings with a female die, and an unloading plate or parts catcher slides in from below to receive the castings released onto it. The unloading plate containing the castings slides and ejects the casting into parts chutes, from whence they slide into the parts bins. After this process the robot picks up a gate again and moves the gate ahead so that the second castings set is degated and trimmed. The process can be repeated until all castings are removed and trimmed. After the castings have been degated and trimmed, the gate plate slides back and tips up, dumping all scrap, i.e., the gate remnant, flash and overflows, into the scrap conveyor, thus leaving the machine clean and clear for the next shot.

In its broadest aspect, the herein disclosed invention involves an automatic degate and trim machine comprising a means for receiving and positioning a gate, for example a male fixture. Said gate comprising a casting and gate remnant. With the gate positioned in registry with a female die having ejecting means disposed therein, said female die along with a ram descend with force onto the gate to yieldably engage the casting, as well as, separate the gate remnant from the casting while leaving the gate remnant on a gate plate. Once the gate remnant is separated from the casting, the ram and the female die yieldably engaging the casting are raised to allow a parts catcher to come into position under the female die. With the parts catcher in position said ejecting means is actuated causing the casting to be ejected from the female die onto said parts catcher which delivers the casting into a parts bin for receiving said casting. With the casting out of the way of said gate remnant, a gate plate containing said gate remnant is tilted causing the gate remnant to fall into a scrap bin. The automatic degate and trim machine can have the casting deposited onto a chute prior to delivery to said parts bin and the gate remnant can be deposited onto a chute or conveyor prior to deposit into said scrap bin. Once the cycle is complete the machine can repeat the cycle.

Viewed another way, the invention encompasses an automatic degate and trim machine having as its main components:

a ram, a female die with ejecting means disposed therein, a male die or fixture for receiving a gate comprising a casting, a gate plate and a parts catcher, wherein said gate plate has disposed thereon said with male fixture for receiving a gate, said ram and female die with ejecting means positioned in a raised position over the male fixture being powered and operating reciprocally such that the ram and female die can be lowered with force to cut and separate the casting from said gate leaving a gate remnant and with the female die yieldably retaining said casting within the female portion of the die. With the female die raised the female die can release the casting into a parts catcher and then into a parts bin, the gate plate having received the gate remnant delivers the gate remnant to a scrap bin for recycling. Once the cycle is complete the machine can repeat the cycle.

In its broadest aspect, this invention involves an automated method for removing and separating castings from a gate containing the same comprising placing a gate onto a gate plate wherein a ram and a female die with ejecting means disposed therein descends with force onto the casting of said gate to yieldable engage the castings to separate and trim away gate remnant form the casting, leaving the gate remnant on said gate plate, with the gate remnant separated from the castings, the castings are separated and deposited into individual groups for deposit into separate bins and the gate remnant is removed from the gate plate for placement into scrap. This method allows for ready determination of imperfections in the different castings.

DESCRIPTION

Figure 1:
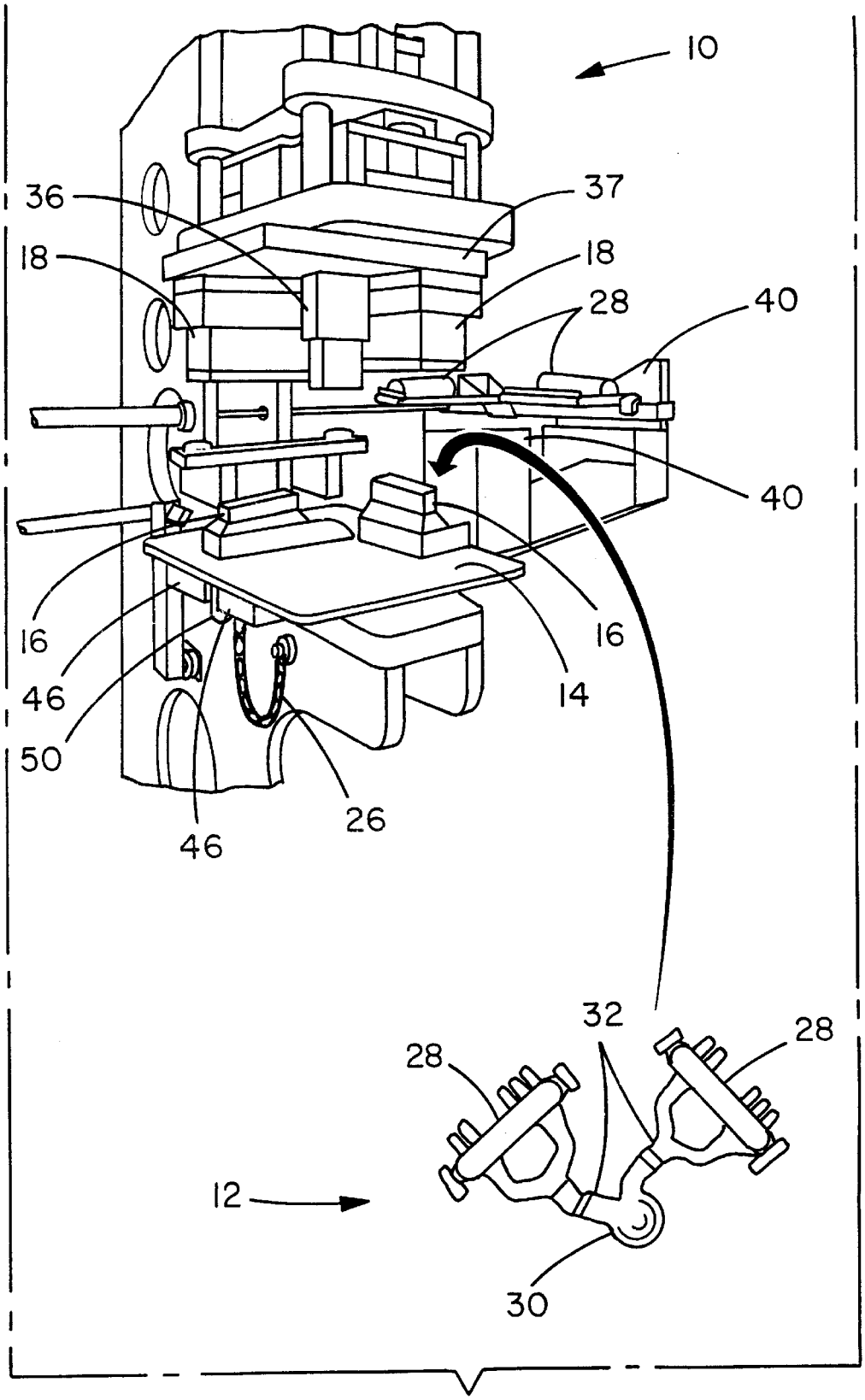
FIG. 1 is a pictorial view of the automated degate and trim machine displaying a greatly enlarged gate (casting assemblage).

With reference to FIG. 1 the automated degate and trim machine 10 for receiving a gate 12 onto a degate plate 14 (arrow) has disposed thereon a set of male fixtures or lower dies 16 for positioning the gate 12. Above the male fixtures is a set of female dies 18. The female dies 18 function in cooperation with a parts catcher 20 and a chute 22 (explained below). The degate plate 14 functions with a chain 26 to drop gate remnant 34 into a chute or recycling bin 28 (explained below). The gate 12 is composed of castings 28, a sprue or biscuit 30 and runners 32. The sprue 30 is the opening through which molten metal is poured into the mold. As used herein the sprue is a waste piece of metal which the robot (not shown) can grasp and hold onto. The runners 32 are composed of metal which was poured into the mold.

Figure 2:
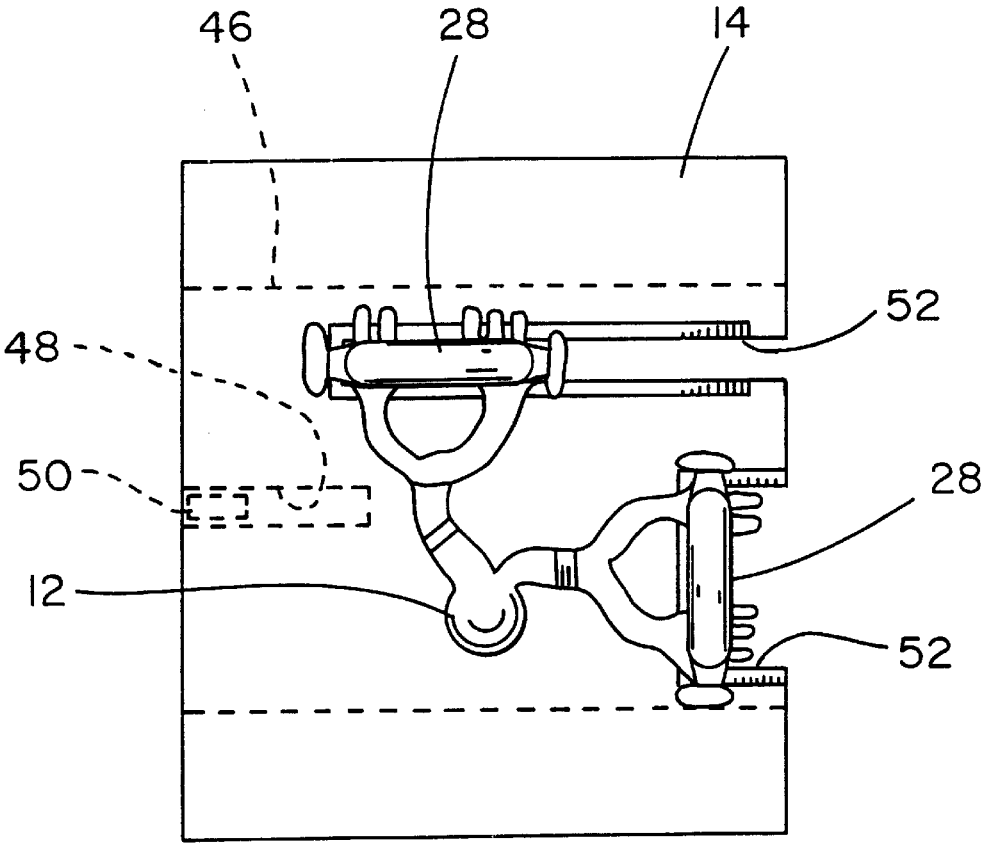
FIG. 2 is a plan view showing the gate received on the gate plate. The gate plate is supported on a gate plate support or lower platen shown in dashed lines.

Referring to FIGS. 1 and 2 in operation a robot (not shown) brings the gate 12 and places the castings 28 within the gate 12 onto lower die or male positioning means 16 which are attached to a lower platen, explained below. Once the gate castings 28 are positioned on the male positioning means 16 the castings will be in registry with female dies 18 mounted above the castings 28. As shown in FIGS. 4–8, the female dies 18 descend onto the castings 28, and with the sharp edges of the die, as well as with pressure exerted by ram or punch 36 through the hydraulic system sever the castings 28 from the gate leaving gate remnant 34 on the degate plate 14. The ram or punch 36, as well as the female dies, are attached to an upper platen 37 which, in turn, is driven by a fluid or air cylinder (not shown).

Figure 3:
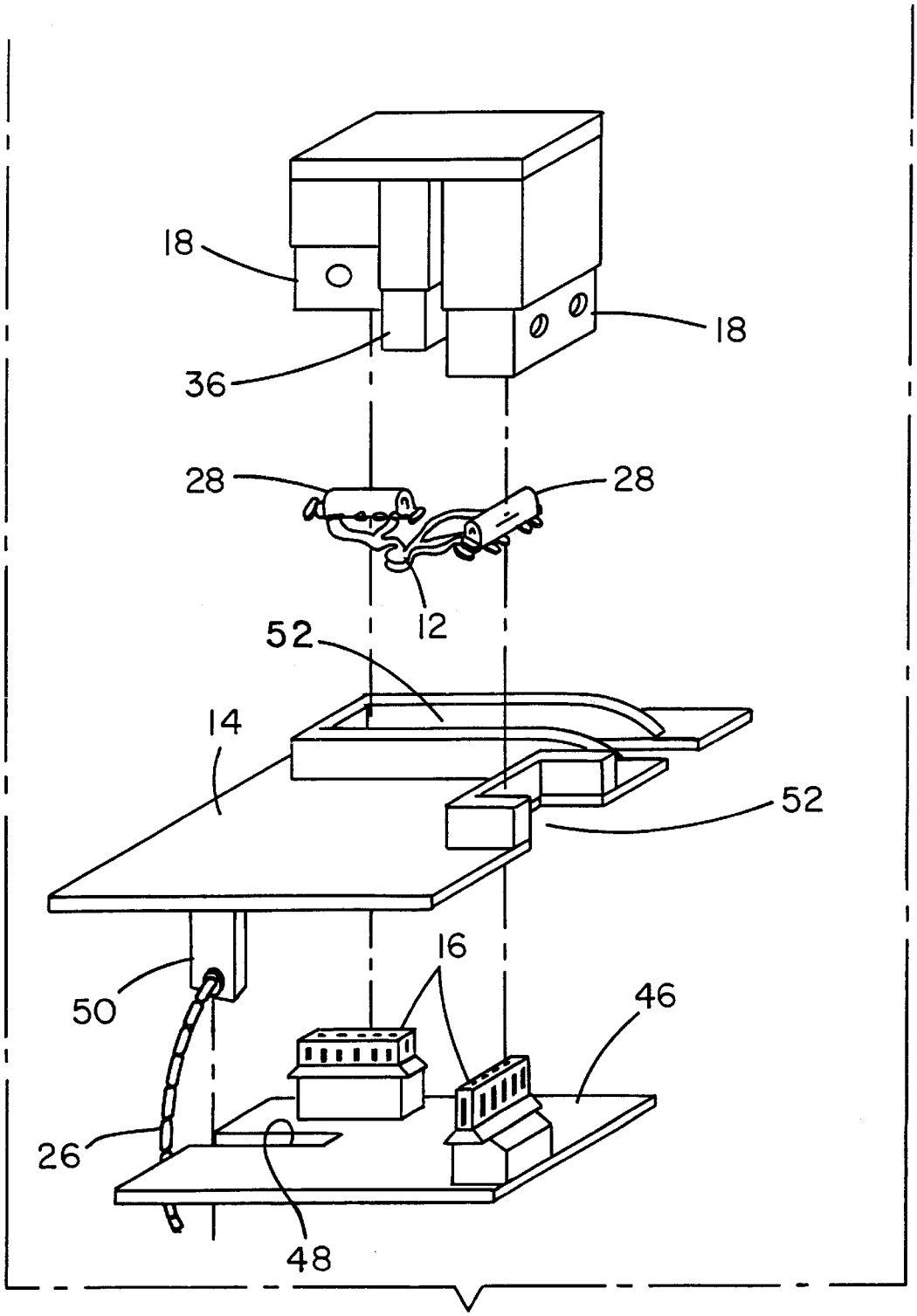
FIG. 3 is an exploded view showing the components making up the gate plate and male projections, gate plate support and their relationship to the gate, female dies and punch.

With reference to FIG. 3, there is shown an exploded view of the ram 36 and female dies 18, the gate 12, the degate plate 14 and the gate plate support or lower platen 46. The degate plate support or platen 46 is stationary while the degate plate is able to translate from right to left to dump the gate remnant and return to its original position (explained below). The degate plate support or lower platen 46 is shown with male fixtures or lower dies 16 disposed thereon, as well as guide slot 48 for receiving projection 50 under the degate plate. Guide slot 48 in conjunction with projection 50 may help stabilize the translation and return of the degate plate or stabilization can be attained by separate ways, guide rods or guide rails. Projection 50 also retains the chain. Open cut-outs 52 in the gate plate accommodate the male fixtures 16. In addition, the cut-out access 52 allows for the degate plate 14 to translate while the degate plate support or platen remains stationary. The male fixtures or male dies are placed on the stationary degate plate or platen support and receive a major amount of force from the thrust of the ram and female dies. As an alternative embodiment, the male and female dies can be, and sometimes are, reversed in position.

Figure 4:
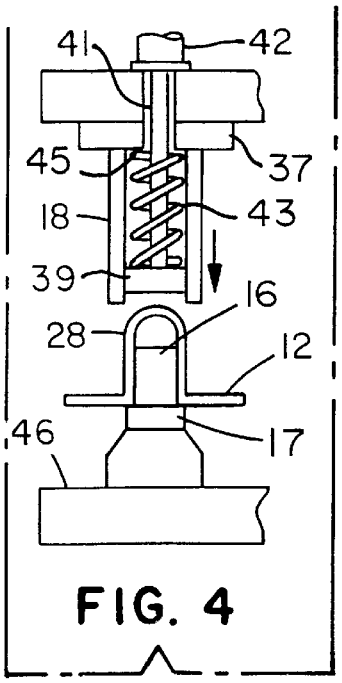
FIGS. 4–8 is a series of views showing the casting being severed and received into the female die and at a proper time released therefrom. The end of the female die and the end of the casting have been removed to show the inner mechanism of the female die and how the casting sits on the male fixture.
Figure 5:
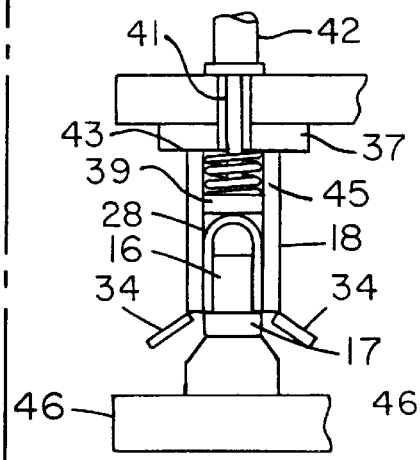
Figure 6:
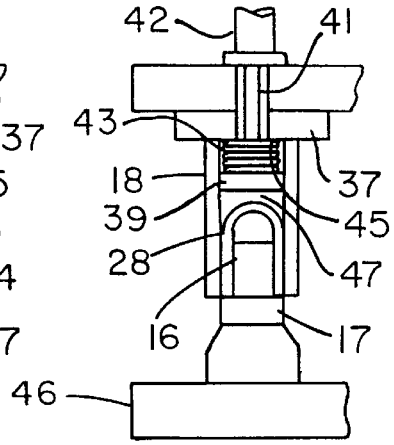
Figure 7:
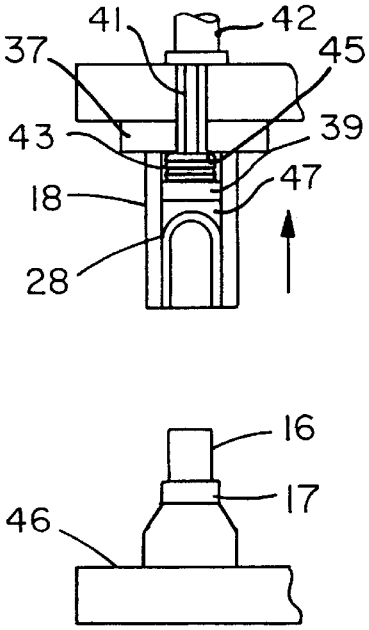
Figure 8:
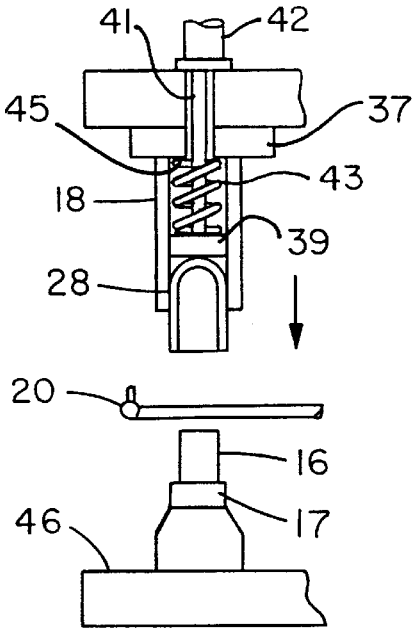

More specifically, referring to FIGS. 4–8, a female die 18 shown with its end removed has disposed in the top compartment 45 of the die 18, a pad 39 on the first end of a shaft 41 with the second end the shaft joined to a pad lift cylinder guide 42. A spring 43 is positioned around the shaft 41 with the ends of the spring 43 abutting the pad 39 and the top of the die compartment 45. As shown in FIG. 4 prior to the descent of the die 18, the pad lift cylinder (not shown) is relaxed, the spring 43 is extended in a relaxed position. Once the ram cylinder (not shown) is actuated, the female die 18 descends (arrow) upon the gate 12 with the casting 28 shown with end removed in the gate 12 (FIG. 5). In FIG. 5 the casting is trimmed. During this step the pad 39 has remained in contact with the descent of the upper platen 37. This holds the casting firmly on the lower male die or fixture. Note particularly that in FIGS. 4–8 the male die or fixture 16 is shown with a square shoulder 17 which is able to more securely position the casting 28 for severing and trimming. The male die 28 with the square shoulder is a preferred embodiment of this invention. After the casting has been severed (FIG. 6) the pad 39 is lifted leaving a gap 47. This gap is brought about by the hydraulic cylinder raising the pad off of the casting. This release of the pad (gap) is necessary; otherwise, the spring would push the casting out of the female die as soon as the ascent began. With ascent (arrow) of the die (FIG. 7) the casting is wedged in the female die so that the die lifts the casting as the upper platen 37 ascends. The pad lift cylinder (not shown) is retracted, holding the spring 43 back. Note that in FIGS. 5–7 spring 43 is compressed. As a final step (FIG. 8) the pad lift cylinder relaxes causing the spring 43 and pad to push the casting 28 out of the upper die 18 (arrow). However, in operation, prior to the casting being ejected from the female die, parts catcher 20 moves under the female die to catch the casting 28 being ejected as explained below.

Figure 9:
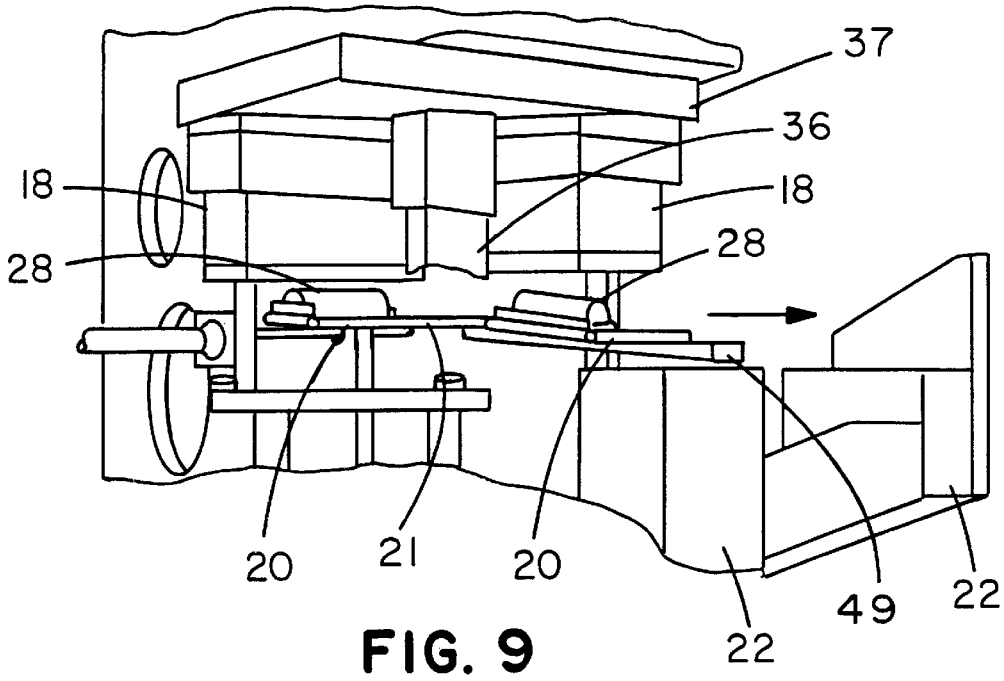
FIG. 9 is a view of the female dies having released the castings into the parts catcher.
Figure 10:
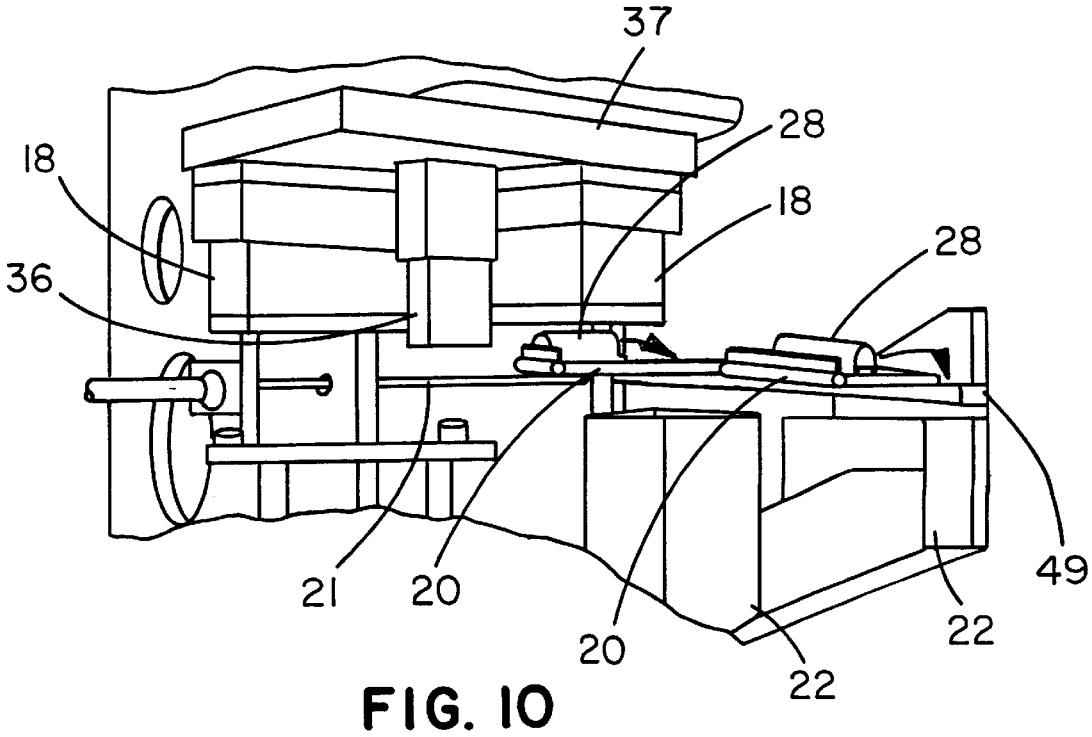
FIG. 10 is a view showing the parts shunted onto a parts chute.
Figure 11:
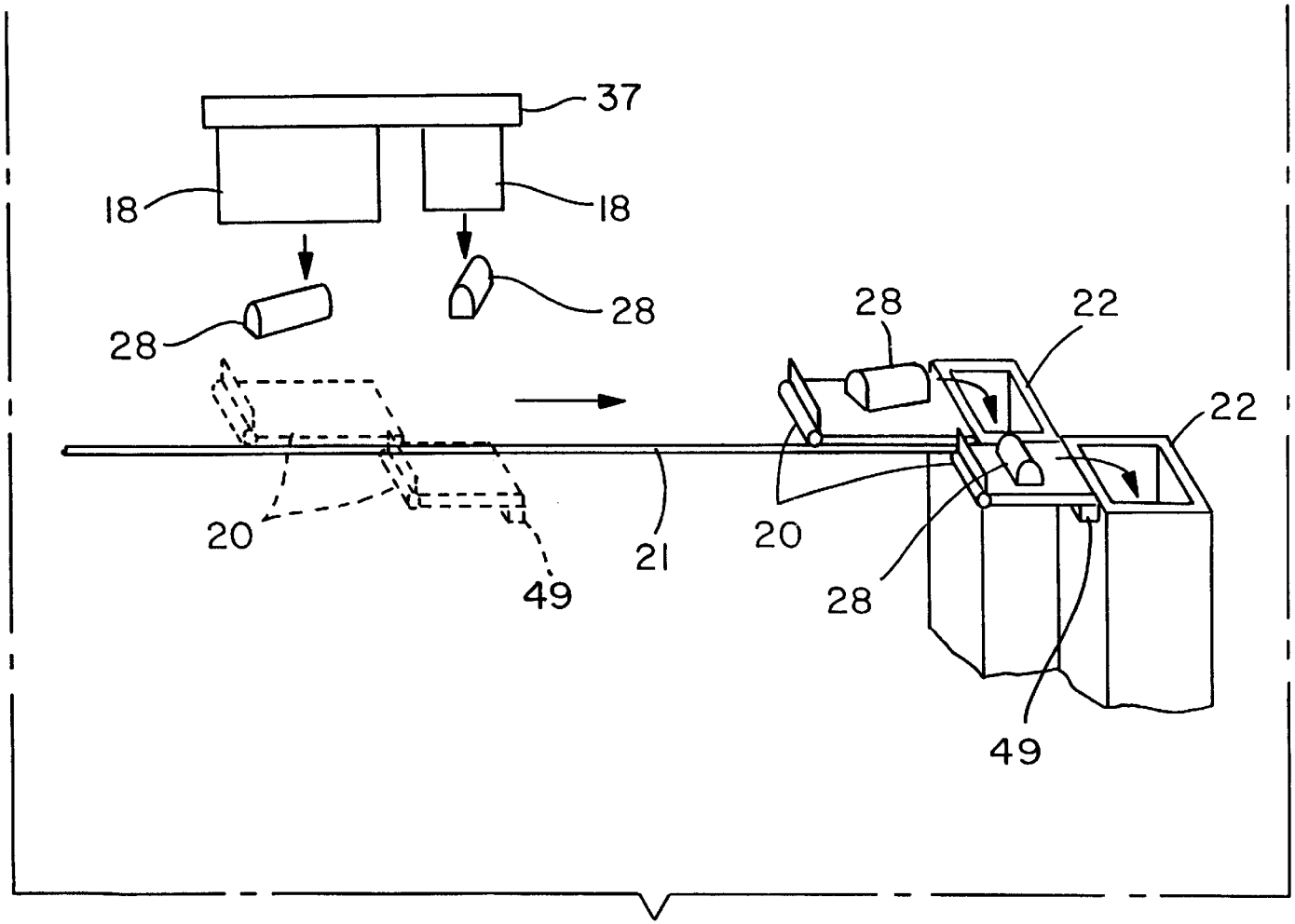
FIG. 11 is a schematic view of the castings being released from the dies and then shunted onto a parts chute.

As described by FIGS. 9–11, the female dies 18, employed to sever the casting 28 from the gate 12, are made so as to yieldably grasp and retain the casting 28. This is normally effected in that the castings once trimmed will naturally fit snuggly inside the female die. Once castings are severed the female dies retaining the castings therein are raised through means of the hydraulic press (ram) which opens lifting the castings with the female die. Referring specifically to FIG. 11, an unloading plate or parts catcher 20 slides in below the castings held in the female dies to receive the castings which are released onto the parts catcher 20. The arrows in FIGS. 9–11 show direction of movement of the castings 28.

Referring specifically to FIG. 11, upon release from the dies 18 the castings 28 drop into the parts catcher 20 shown on the left in slashed lines (FIG. 11). The parts catcher is made to move rapidly to the right (shown by arrow) striking into its stops 49 and coming to an abrupt halt. At the end of the guide rails or rods is a rubber sleeve or bumper which takes up shock when the guide rail comes to the end of its travel. The parts catcher 20 is attached to a rod 21 which, in turn, is attached to the hydraulic system (not shown). Since the castings 28 cannot stop as fast as the parts catcher 20 stops the castings are thrown by their momentum to the right and onto receiving chutes 22 shown by arrows for delivery to a parts bin. The motion of the parts catcher is controlled by guide rods and sleeves shown in FIGS. 1 and 9–11. The motive force is produced through hydraulic or air cylinders. Attention is directed to the fact that the castings are delivered to two separate baskets on the parts catcher 20. Two separate chutes 22 and two separate parts bins for receiving parts are employed. The advantage of two separate chutes is that the parts can be separately examined for flaws based on the individual parts in the bin and adjustments can be made for each individual line run. This segregation is particularly useful where multiple, and particularly more than two, castings are being dealt with. While the invention has been described as the finished castings being deposited into a chute and then a parts bin, the finished product could have been deposited directly into the parts bin.

Figure 12:
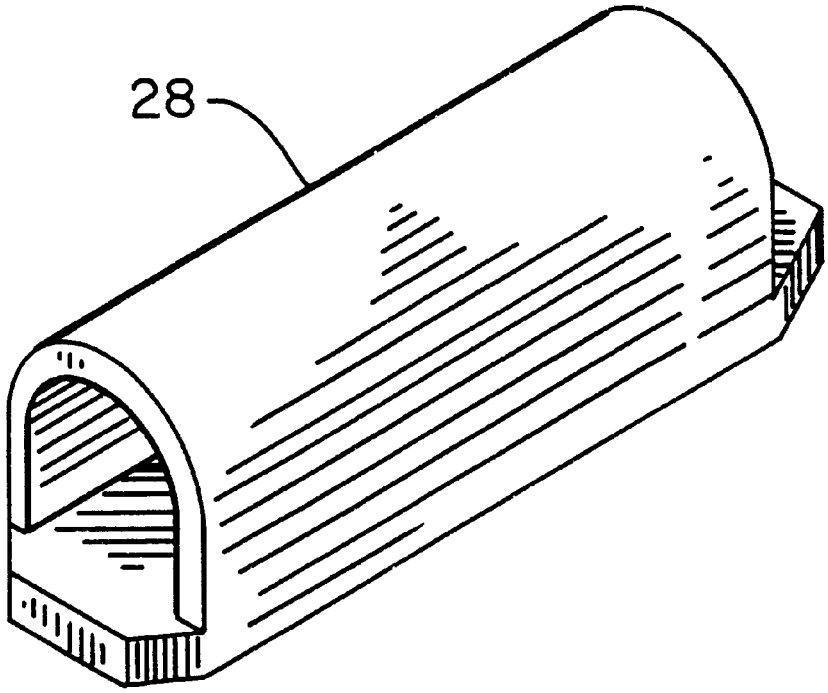
FIG. 12 is a view of a finished casting.

With reference to FIG. 12, there is shown the finished casting 28. The casting shown is a cast part of a door closer. It is obvious that the automated degate and trim machine could handle castings of unlimited shapes and sizes and the invention is not limited to any particular casting configuration.

Figure 13:
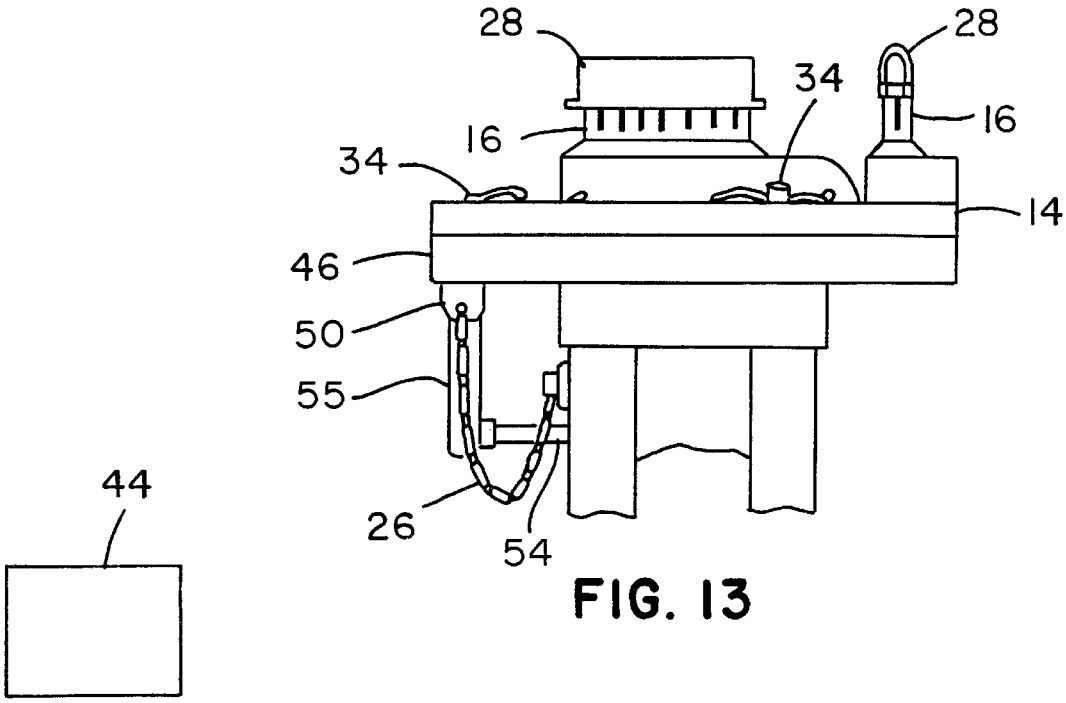
FIG. 13 is a view of the casting received on the gate plate, with the chain in a relaxed position.
Figure 14:
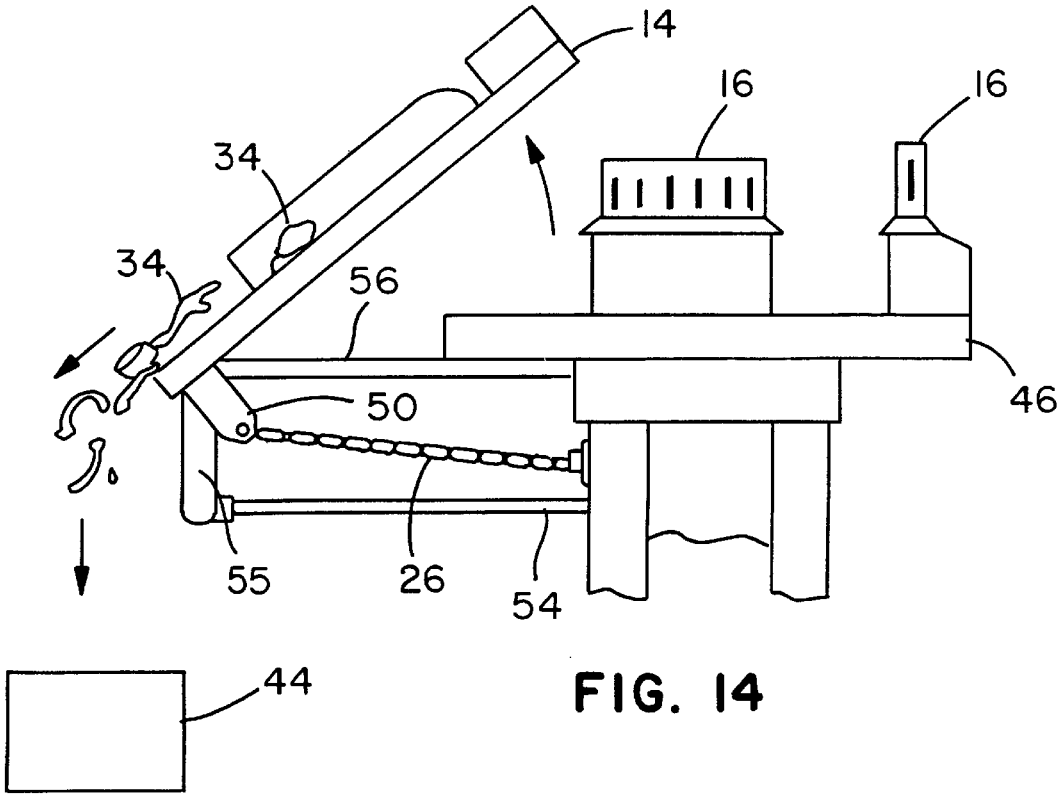
FIG. 14 is a view of the gate plate translating and depositing the gate remnant into a scrap bin after the casting has been separated. The chain is in a taut position.
Figure 15:
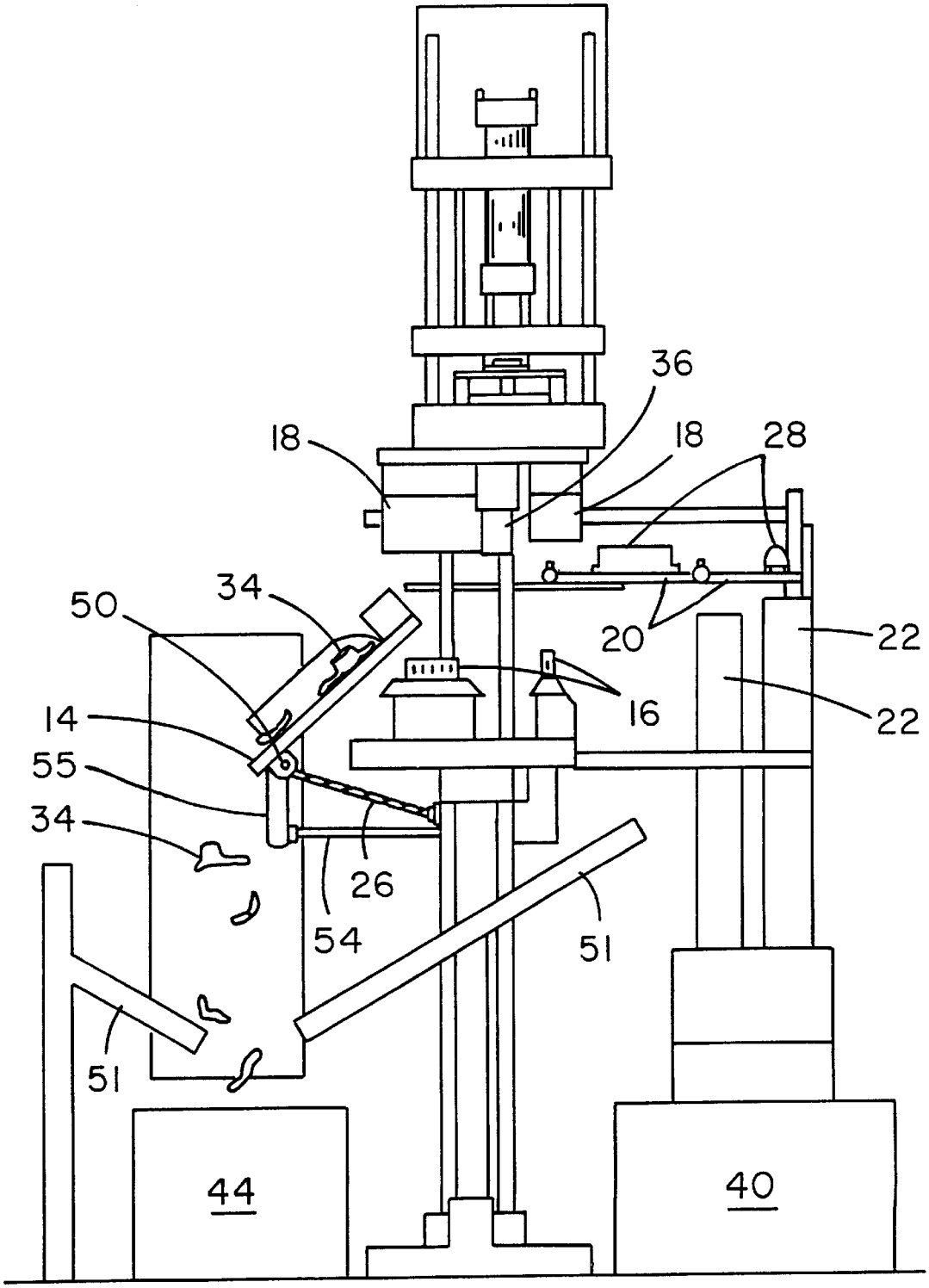
FIG. 15 is a front view schematic representation of an automatic degate and trim machine disposing of gate remnant and shunting the finished castings into a chute and then to the parts bin.
Figure 16:
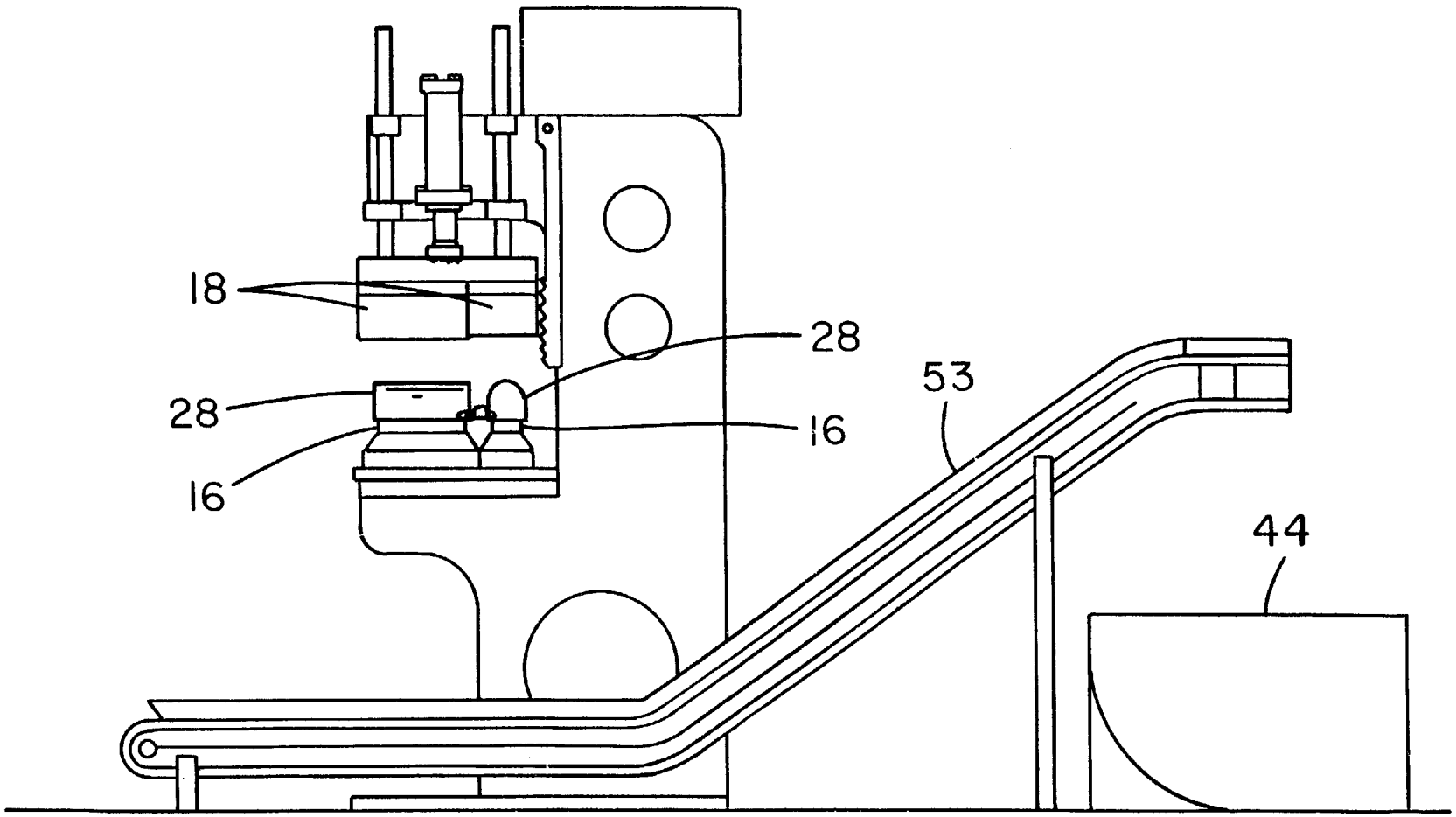
FIGS. 16–20 are a series of views describing the procedural steps by which the machine operates.
Figure 17:
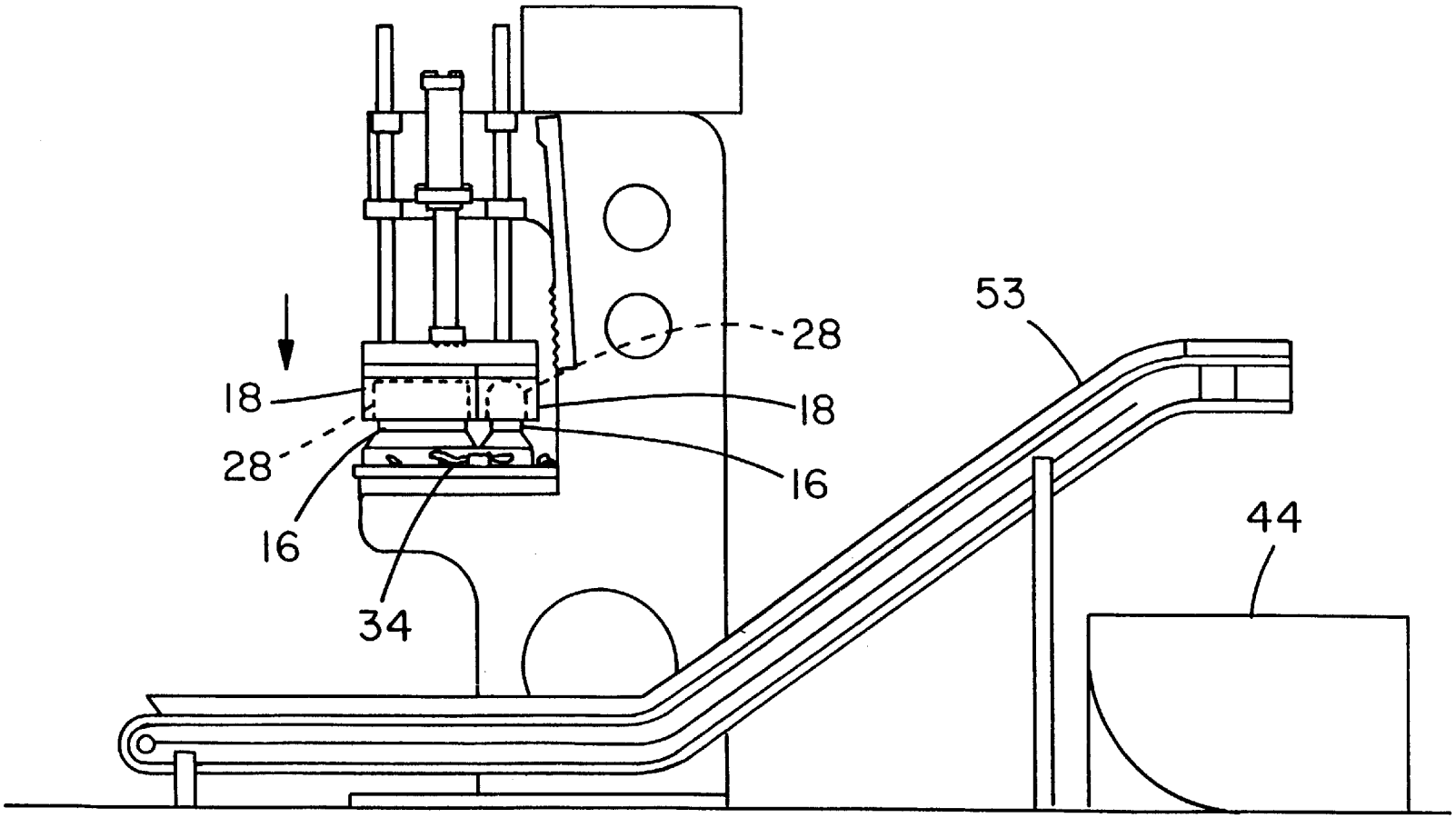
Figure 18:
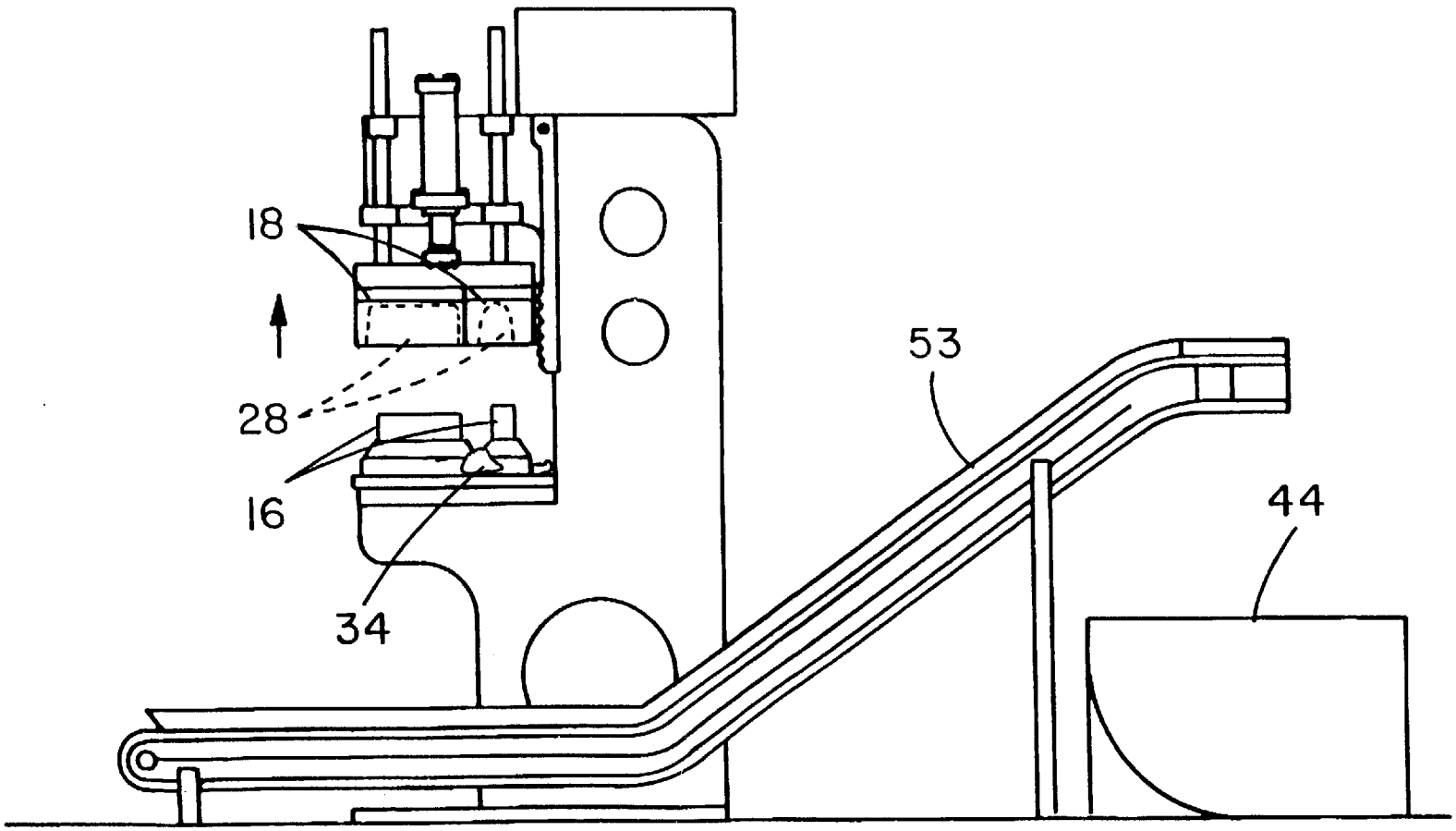

With reference to FIGS. 13–15, once the casting is separated from the gate 12 there remains a gate remnant 34 on the degate plate 14. The gate remnant is removed from the degate plate by the degate plate 14 translating to the left in a straight line until a slack chain 26 (shown in FIGS. 13–15) becomes taut causing the degate plate 14 which is hinged (not shown) to tilt dropping the gate remnant onto a scrap bin 44 where the remnant can be recycled. Instead of the scrap being placed in bin 44, it can be placed onto a conveyor 53 as shown in FIGS. 16–18. With degate plate unloaded it is returned to its original position and the cycle can be repeated. Detail of the degate plate 14 and degate plate support are shown in FIGS. 2 and 3. In FIGS. 13–15 a chain 26 is shown, however, the chain could be substituted with a cable or like device.

Referring more specifically to FIGS. 13–15, the gate plate 14 is able to translate from right to left and dump gate remnant 34 onto scrap bin 44. The mechanism by which translation and dumping takes place is that the hydraulic system drives shaft attached to brace 55 which, in turn, is attached to guide shaft 56. The left end of the gate plate 14 is hinged at the juncture of brace 55 and guide shaft 56. As previously pointed out, the scrap placed onto a conveyor is more convenient since the conveyor can facilitate recycling.

Referring to FIG. 15 there are shown auxiliary gate remnant deflectors 51 which direct stray pieces of remnant onto a chute, conveyor or scrap bin. For ease of recycling, a conveyor is preferred because with a conveyor the process will be more continuous. The conveyor can lead directly to the furnace.

Figure 19:
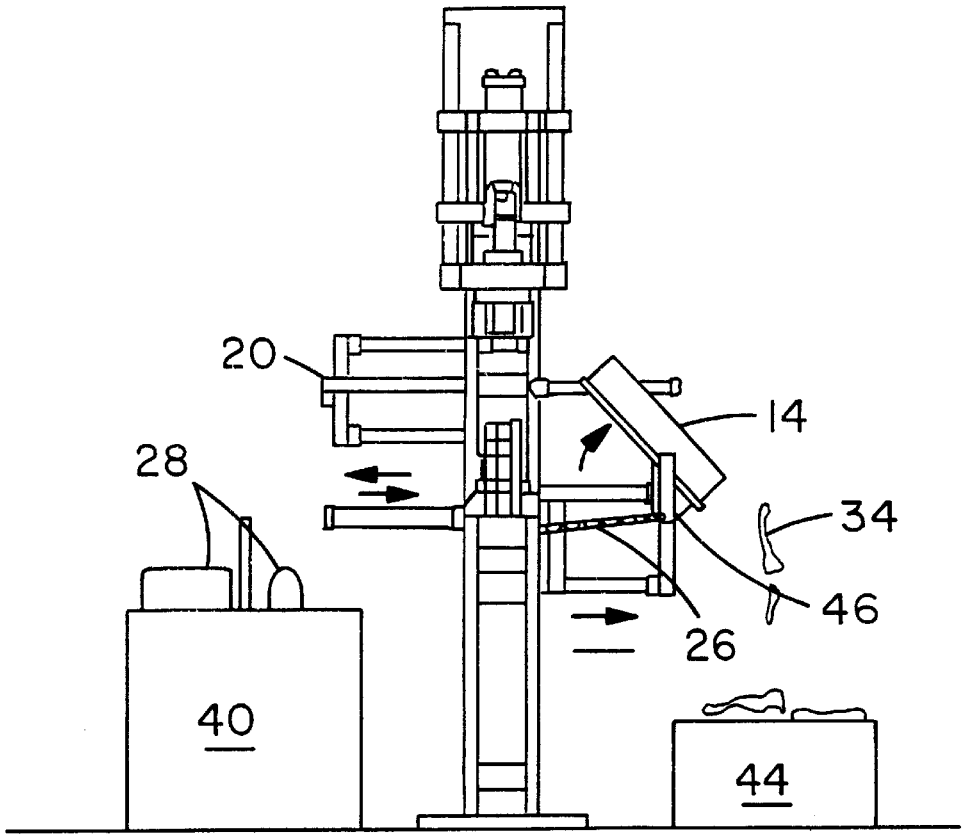
Figure 20:
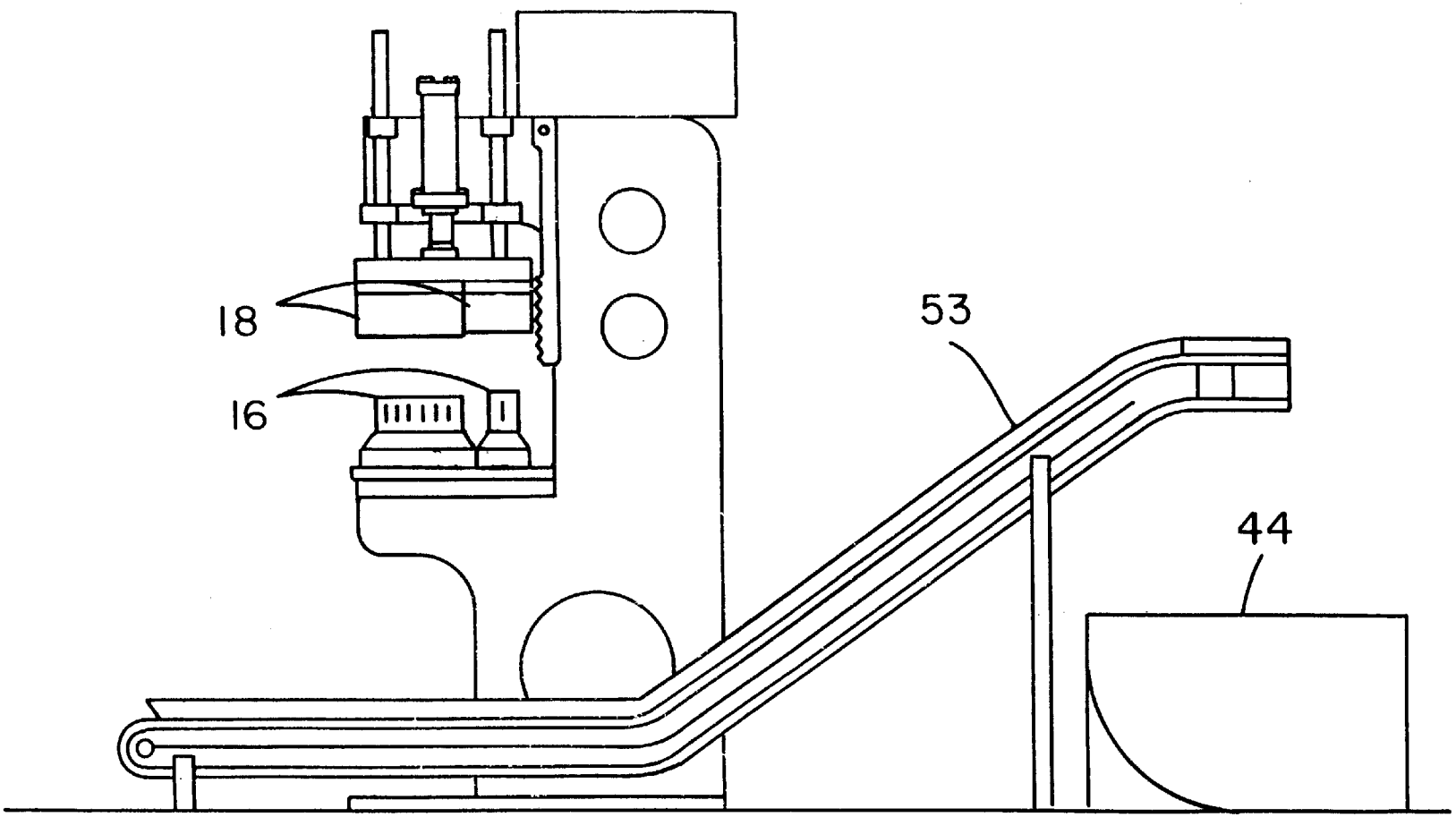

FIGS. 16–20 briefly describe the steps of the machine process. FIG. 16 shows the machine with the gate 12 on the lower dies 16. Scrap conveyor 53 carries scrap to the scrap bin 44. With reference to FIG. 17 the female die 18 grasp the castings after the gate 12 is broken. The castings 28 are shown in dashed lines and arrow shows direction of the die. The dies are raised (arrow) with the castings and the castings are released into a parts catcher (not shown) (FIG. 18). Referring to FIG. 19, the gate remnant 34 is deposited into a scrap bin 44 and the castings into the parts bin. Arrows show the reciprocal action of the parts catcher. The tilt of the gate plate and its translation are shown by arrows. With the cycle complete the machine is ready for the next gate (FIG. 20).

An alternative embodiment of this invention is the combination of a gate plate support and a gate plate comprising said gate plate support having male fixtures on the top surface of the gate plate support, said gate plate having slots through which said male fixtures protrude and also allow the gate plate to translate, said gate plate being able to translate and tilt to dispose of gate remnant on the gate plate, said male fixtures being able to receive a casting in a gate. The mechanism to cause the gate plate to translate is a chain and sprocket arrangement. The gate plate can be made to tilt by a hinge and tension on a chain attached to the gate plate. With the slack taken out of the chain, the gate plate will tilt, dumping the gate remnant as herein disclosed.

As an alternative embodiment, the gate plate could be cleared of gate remnants by a wiper, such as a windshield wiper, or the scraps could be removed by magnetic attraction.

The female dies and ram are actuated by hydraulic means, however, other motive forces known to those skilled in the art could be used to operate the dies and ram.

The invention has been described in the context of twin castings. It is obvious that the machine could be fashioned to accept a greater number of castings, or could be fashioned to accept a single casting.

CONTROL SEQUENCE

The control is an ordinary action-reaction type control, using an ordinary Programmable Logic Controller. The program is basically the same for all castings being run. All program-initiated actuation are via solenoid valves, to cause motion in hydraulic or air cylinders.

The machine cycle starts as a robot brings the gate over from the die casting machine and sets it (the gate) onto the lower (male) fixtures. At this point, a spring-loaded pin is depressed, actuating a part-present sensor that is an input to the control:

| Control Input | | Subsequent Control Output |
|---|---|---|
| ● Part present sensor is made | Program→ dictates | ● Solenoid valve is shifted to send the ram and female dies onto its downward journey |

Mechanical: The ram or punch extends downward until it "bottoms out" at its stall point. Before bottoming out, a pressure pad inside the female die(s) will have firmly pressed the castings onto the male fixture(s), thus locating the casting firmly, and then an instant later the female die trims away all the flash, overflows and gate remnants. The casting is now "stuck" inside the female (upper) die(s).

| | | |
|---|---|---|
| ● Ram "down" sensor is made | Program→ dictates | ● Solenoid is shifted to lift the pressure pad that pushes down on the trimmed castings. |

Mechanical: The pressure pad lifts against the spring.

| | | |
|---|---|---|
| ● Pressure pad lift sensor is made | Program→ dictates | ● Solenoid is eneegized to lift the ram. |

Mechanical: The ram and female dies ascend, with the castings stuck inside the dies. Ram cylinder bottoms out.

| | | |
|---|---|---|
| ● Ram "up" sensor is made | Program→ dictates. | ● Solenoid for scrap plate is energized.<br>● Solenoid for parts catcher is energized. |

Mechanical: The scrap plate translates to the left (in a straight line) until the chain slack is taken up, whereupon further leftward motion causes the scrap plate to tip up. Eventually, the actuating cylinder bottoms out.

Meanwhile, the parts catcher mechanism has translated in (from right to left) until the parts catchers themselves are directly under the castings. The actuating cylinder bottoms out.

| | | |
|---|---|---|
| ● Two sensors are made, one for each of the foregoing motions | Program→ dictates | ● Solenoid for scrap plate is reversed.<br>● Solenoid for parts, catcher is reversed. |

Mechanical: scrap plate flops back down and translates back to its original (R.H.) position.

And, the parts catcher moves rapidly to the right, striking into its stop and coming to an abrupt halt. The castings cannot stop that fast, so they are thrown to the right and end up going down the chutes.

| | | |
|---|---|---|
| ● Two sensors are made, one for each of the foregoing motions | Program→ | ● End of program. Await new signal from part present sensor to start next sequence. |

Note that all actuating cylinders run to, and are arrested by, stops. These stops are rubber rings that also act as shock absorbers.

While the invention employs hydraulic or air cylinders for motive force, other power sources readily apparent to those skilled in the art are envisioned by this invention.

ADVANTAGES

Many advantages accrue to the automatic degate and trim machine of this invention.

The machine will operate with conventional robots of the type that are used in die casting plants.

The machine is able to keep itself clean.

The machine will trim progressively if desired, so that it does not have to be as big as conventional degate and trim machines presently in use. This permits use of smaller capacity equipment requiring less space. Thus, the machine of this invention will be able to trim and dispose of large pieces of gate remnant, as well as small scrap that ordinarily would build up to impeded the functioning of the machine.

The robot does not need to be involved during the processing of the last castings set, nor during gage plate dump, freeing it (the robot) to return to the die casting machine for the next gate.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An automatic degate and trim machine comprising:

a means for receiving and positioning a gate made of a casting and gate remnant, a ram joined to a female die having ejecting means disposed therein, a tilting gate plate, parts catcher, and a parts bin;

in operation after the gate is positioned on the means for receiving and positioning said gate, the ram joined to said die having ejecting means disposed therein descend with force onto the gate to yieldably engage the casting, as well as, to separate the gate remnant from the casting while leaving the gate remnant on said tilting gate plate, once the gate remnant is separated from the casting, the ram and the female die yieldably engaging the casting are raised to allow a parts catcher to come into position under the female die, once the parts catcher is in position said ejecting means deposed in said female die is actuated causing the casting to be ejected from the female die onto a parts catcher which delivers the casting into a parts bin for receiving said casting, with the casting out of the way of said gate remnant, said gate plate containing said gate remnant is tilted causing the gate remnant to fall into a scrap bin.

2. The autoniatic degate and trim machine of claim 1 further comprising a chute wherein the casting is deposited onto said chute prior to delivery to said parts bin.

3. The automatic degate and trim machine of clam 1 further comprising a chute wherein the gate remnant is deposited onto said chute prior to deposit into said scrap bin.

4. The automatic degate and trim machine of claim 1 wherein the gate plate is translated and tilted causing the gate remnant to fall into a scrap bin.

5. An automatic degate and trim machine for removing a casting from a gate comprising:

a ram, a female die with ejecting means disposed therein, a male fixture for receiving a gate comprising a casting, a gate plate and a parts catcher, wherein said gate plate has disposed thereon said with male fixtures for receiving a gate, said ram and female die with ejecting means positioned in a raised position over the male fixture being powered and operating reciprocally such that the ram and female die can be lowered with force to cut and separate the casting from said gate leaving a gate remnant and with the female die yieldably retaining said casting within the female portion of the die, with the female die raised the female die can release the casting into a parts catcher and then into a parts bin, the gate plate having received the gate remnant delivers the gate remnant to a chute or to a scrap bin.

6. The automatic degate and trim machine of claim 5 wherein the gate plate tilts to deliver the gate remnant into the scrap bin.

7. The automatic degate and trim machine of claim 5 wherein the gate plate translates and tilts to deliver the gate remnant into the scrap bin.

8. The automatic degate and trim machine of claim 5 wherein the gate remnant is delivered onto a chute or conveyor prior to delivery into a scrap bin.

9. An automatic degate and trim machine comprising:

a means for receiving and positioning a gate made of a casting and gate remnant, a ram joined to a female die having ejecting means disposed therein, parts catcher, parts bin, gate plate, and scrap bin;

in operation after the gate is positioned on means for receiving said gate said ram and female die having ejecting means disposed therein descend with force onto the gate to yieldably engage the casting, as well as, separate the gate remnant from the casting while leaving the gate remnant on said gate plate, once the gate remnant is separated from the casting, said ram joined to the female die yieldably engaging the casting are raised to allow said parts catcher to come into position under the female die, once the parts catcher is in position said ejecting means is actuated causing the casting to be ejected from the female die onto the parts catcher which delivers the casting into said parts bin for receiving said casting, with the casting out of the way of said gate remnant, said gate plate containing said gate remnant is cleared causing the gate remnant to fall into said scrap bin.

* * * * *